United States Patent [19]

Beers et al.

[11] Patent Number: 5,042,267

[45] Date of Patent: Aug. 27, 1991

[54] COMBINATION EVAPORATOR AND RADIANT HEATER DEFROST MEANS

[75] Inventors: David G. Beers, Evansville, Ind.; David P. O'Toole, Jr., Louisville, Ky.

[73] Assignee: General Electric Company, Louisville, Ky.

[21] Appl. No.: 593,749

[22] Filed: Oct. 5, 1990

[51] Int. Cl.[5] ..... F25D 21/08

[52] U.S. Cl. ..... 62/276; 219/520; 392/347; 392/374

[58] Field of Search ..... 62/276; 219/520; 392/347, 374, 375, 408

[56] References Cited

U.S. PATENT DOCUMENTS

| | | | |
|---|---|---|---|
| 516,152 | 3/1894 | Cochrane | 392/347 |
| 1,297,472 | 3/1919 | Hynes | 219/520 X |
| 1,327,986 | 1/1920 | Clark et al. | 392/347 X |
| 1,840,168 | 1/1932 | Mucher | 219/520 X |
| 2,648,514 | 8/1953 | Rosier et al. | 219/520 X |
| 2,711,471 | 6/1955 | Sussman | 392/347 X |
| 2,722,596 | 11/1955 | Drouet | 219/520 X |
| 3,436,931 | 4/1969 | Gelbard | 62/276 |

*Primary Examiner*—William E. Tapolcai

*Attorney, Agent, or Firm*—Radford M. Reams; H. Neil Houser

[57] ABSTRACT

A combination evaporator and radiant heater defrost means including a heater housing which prevents defrost water from impinging directly on the heater while enhancing defrosting of the evaporator.

12 Claims, 4 Drawing Sheets

COMBINATION EVAPORATOR AND RADIANT HEATER DEFROST MEANS

BACKGROUND OF THE INVENTION

Many modern refrigerators include an evaporator which normally operates at below freezing temperatures, at which a layer of frost builds up on the surface of the evaporator. In order to quickly defrost the evaporator, a radiant heater is positioned below the evaporator so that the evaporator is warmed by both radiant and convection heating. One suitable type of radiant heater comprises a coil of heater wire encased in a heat resistant and electrically insulated tube of quartz or similar material. Such heaters operate at temperatures above the boiling point of water and quickly warm the surface of the evaporator to defrost temperatures. When the frost melts, the defrost water drops down. If it is allowed to impinge on the heater structure it will produce undesirable noises during defrost operations. It is well known to provide some type of shield to prevent the water from impinging directly upon the heater. One such shield structure is shown in U.S. Pat. No. 3,436,931—Robert B. Gelbard, assigned to General Electric Company, assignee of the present invention; which patent is incorporated herein by reference. It is normal to provide a single evaporator for both the freezer and the fresh food compartment and to place the evaporator in an evaporator compartment positioned behind the freezer compartment. Such arrangements are crowded and it is difficult to both shield the heater from direct impingement by defrost water and to effectively and uniformly defrost the evaporator.

An object of the present invention is to provide an improved evaporator and defrost heater combination which shields the heater from direct impingement by defrost water while providing enhanced evaporator defrosting action.

Another object of the invention is to provide a heater and housing arrangement which provides uniform transfer of heat from the heater to the evaporator while shielding the heater from direct impingement by defrost water.

Yet another object is to provide such an arrangement in which the housing compensates for the uneven heat distribution from the heater.

Further objects and advantages of the invention will be apparent from the following description and features of novelty which characterize the invention will be pointed out in the claims attached to and forming part of this specification.

SUMMARY OF THE INVENTION

In accordance with one general form of the present invention there is provided, in combination, a refrigerant evaporator normally operable at frost collecting temperatures and a radiant heater operable at surface temperatures above the boiling point of water for warming the evaporator to defrost temperatures. A housing mounts the heater in substantially spaced, radiant heating relationship with the evaporator and below at least one frost collecting portion of the evaporator. The housing includes a shield structure and spaced apart mounting means supporting the heater in a position with a portion of the shield structure positioned between the heater and the at least one frost collecting portion of the evaporator . The shield structure is formed with a plurality of openings, so sized that the surface tension of defrost water impinging upon the shield will prevent the water from passing through the shield structure and of a sufficient number that significant heat passes through the shield structure.

DESCRIPTION OF THE PREFERRED EMBODIMENTS

Figure 1:
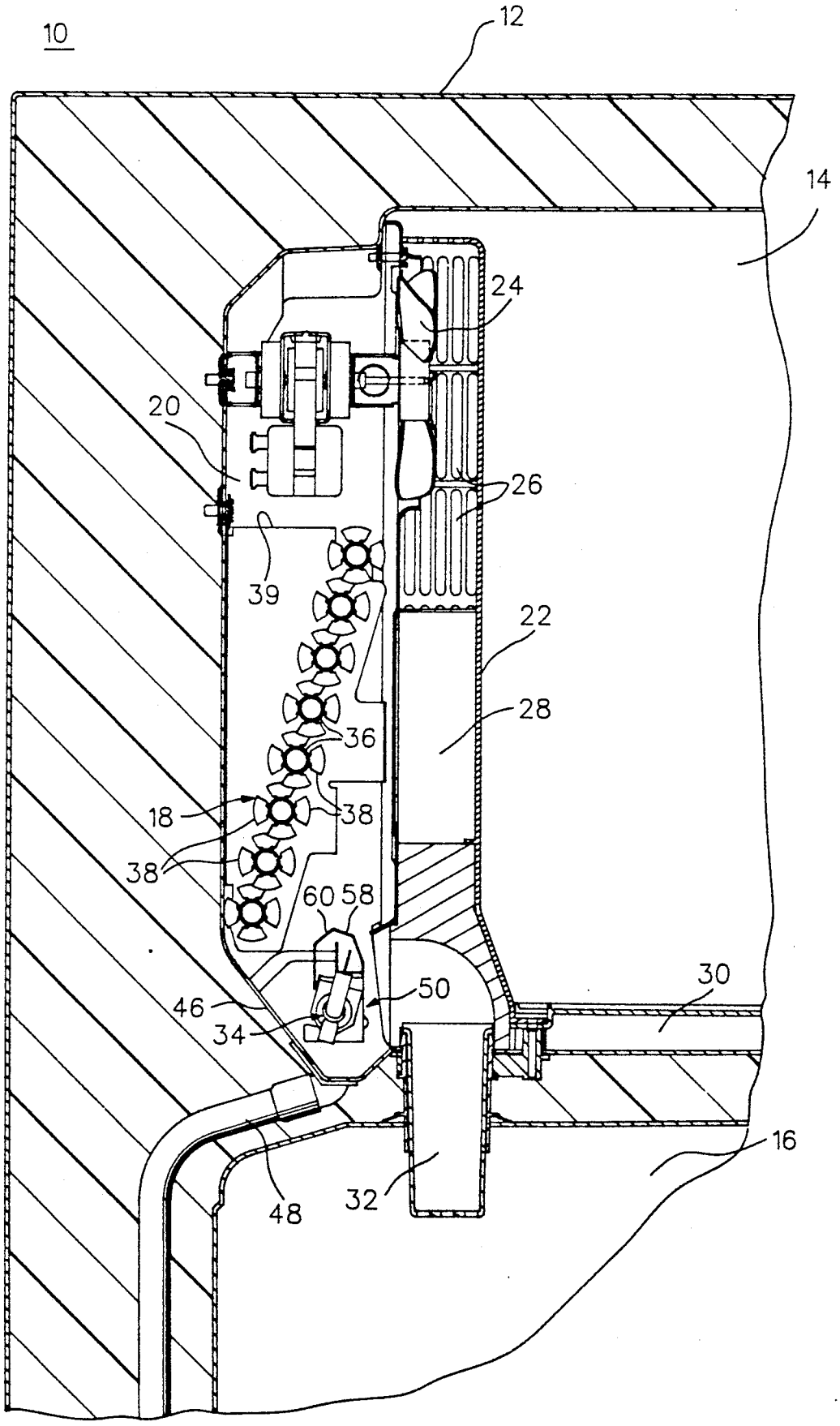
FIG. 1 is a fragmentary cross sectional side elevation view of a refrigerator, illustrating an evaporator and heater combination in accord with one embodiment of the present invention.

The refrigerator 10 illustrated in FIG. 1 includes an outer cabinet 12 containing a freezer compartment 14 and a fresh food compartment 16. The freezer compartment is maintained at sub-freezing temperatures and the fresh food compartment at above-freezing food preserving temperatures by circulating air through these compartments and over an evaporator 18 positioned in a vertically disposed evaporator chamber 20 positioned behind the freezer compartment 14 and separated from it by a wall structure 22. More specifically, a fan 24 positioned in the upper portion of the evaporator chamber or compartment 20 discharges air through openings 26 in the wall 22 into the freezer compartment 14 and through a passage partially shown at 28 to the fresh food compartment. The fan also draws the air within the freezer compartment 14 and fresh food compartment 16 back into the evaporator compartment 20 and over the evaporator. The return air from the freezer compartment flows through a passage partially shown at 30 while the return air from the fresh food compartment flows through passage 32. The freezer compartment is maintained below freezing while the fresh food compartment is maintained above freezing by an appropriate division of the air being discharged from the evaporator compartment with the majority of the air going to the freezer compartment and a smaller portion of the air going to the fresh food compartment. The evaporator 18 is of a type designed to normally operate at below freezing temperatures with the result that moisture contained in the air blowing through the evaporator chamber 20 collects on the evaporator surfaces in the form of frost. Periodically this accumulated frost is removed from the evaporator surfaces by energizing a radiant heater 34 positioned in radiant and convection heating relationship with the evaporator surfaces.

While the evaporator may be of any of a number of well-known types, the illustrative evaporator comprises a tube 36 provided with fins 38. The fins 38 are integral with the tube 36 and extend radially outwardly therefrom with their end portions twisted through an angle of about 90°. Either two sets of fins 38 may be provided on opposite sides of the tube 36 or four such sets may be used as is shown in FIG. 1. The evaporator tube 36 is bent in the form of a serpentine to provide a plurality of horizontal conduit passes in a vertically spaced arrangement connected by return bends, as is well-known in the art. The overall configuration of the evaporator is of a generally rectangular construction and the various passes of the tube 36 are supported in spaced relationship on opposed frame members 39 at opposite sides of the evaporator. The frame members 40 mount the evaporator in a generally vertical position within the evaporator chamber or compartment 20 but slightly angled with respect to the vertical so as to more fully expose the various horizontal passes of tube 36 to the return air flowing upwardly through the compartment 20.

Figure 4:
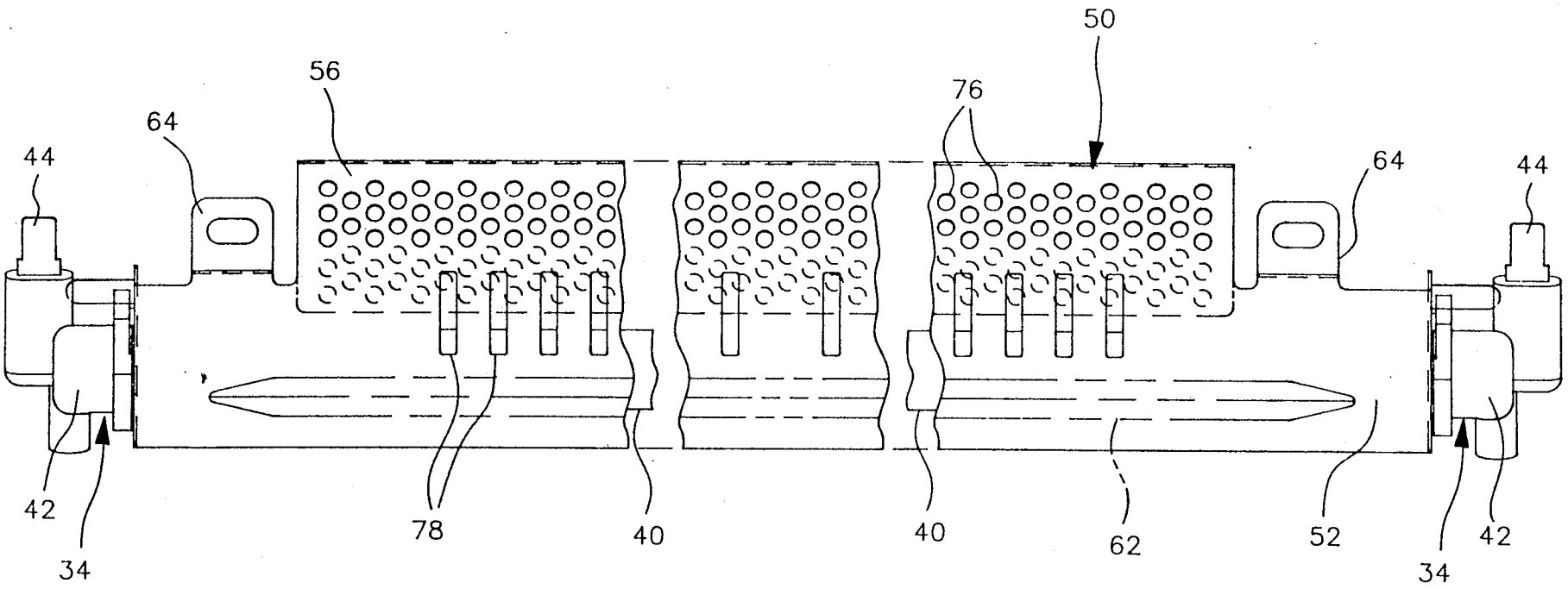
FIG. 4 is a side elevation view of the heater and housing assembly shown in FIG. 1.

In order to periodically warm the evaporator surfaces to defrosting temperatures, a radiant heater 34 is provided. The heater conveniently may be of the type generally described in Turner U.S. Pat. No. 3,280,581 issued on Oct. 25, 1966, and assigned to the same assignee as the present invention. Such heaters, as described in the Turner patent, comprise a tube or envelope of insulating, heat transmitting materials such as a quartz-like material with a radiant heater coil positioned within the tube. Energization of the heater coil provides a substantial amount of heat with the result that, during defrosting of the evaporator, the tube or envelope attains a surface temperature above the boiling point of water. As shown in FIG. 4, for example, the exemplification of heater 34 includes an elongated tube 40 provided at each end with an end cap 42, by which the tube is mounted to an appropriate housing, and contacts 44 for connecting the heater coil to a source of electrical energy.

In refrigerators, as illustrated in FIG. 1, in which the evaporator for the entire refrigerator, the evaporator fan and the evaporator defrost heater are all mounted in a small compartment positioned behind the freezer, space is at a premium. In order to conserve space and also to provide for convection and radiant heating of the evaporator during the energization of the radiant heater, the heater is positioned below the evaporator 18 so that the elongated heater tube 40 runs generally parallel with the horizontal passes of the evaporator tube 36. In the refrigerator of FIG. 1 the heater 34 is positioned below the evaporator in the lower, generally V-shaped, bottom portion 46 of the evaporator chamber 20, which portion forms a drain trough that is also warmed to defrosting temperatures during the defrost cycle. Water accumulating in the lower portion or drain trough 46 is drained from the evaporator chamber through a drain tube 48.

The heater structure 34 occupies a fairly large part of the bottom portion of the evaporator chamber and is positioned immediately below the evaporator. If the heater is left exposed, water dropping from the evaporator as the frost melts will impinge upon the hot tube 40 and will cause undesirable and annoying "sizzling" sounds. In addition, it is quite common for partially melted frost, often referred to as slush, to fall from the evaporator. If such slush were to hit the heater, it would lay there for a longer period of time, causing even more undesirable noise, reducing the heating effectiveness and perhaps adversely affecting the life of the heater. In accordance with the present invention, the heater is provided with an improved combined housing, mount and shield. The housing provides a means for mounting the heater within the evaporator chamber and shields the hot heater surfaces during defrost of the evaporator to prevent water droplets and slush falling from overlying portions of the evaporator from dripping onto the hot surfaces during defrosting of the evaporator.

Figures 5, 6:
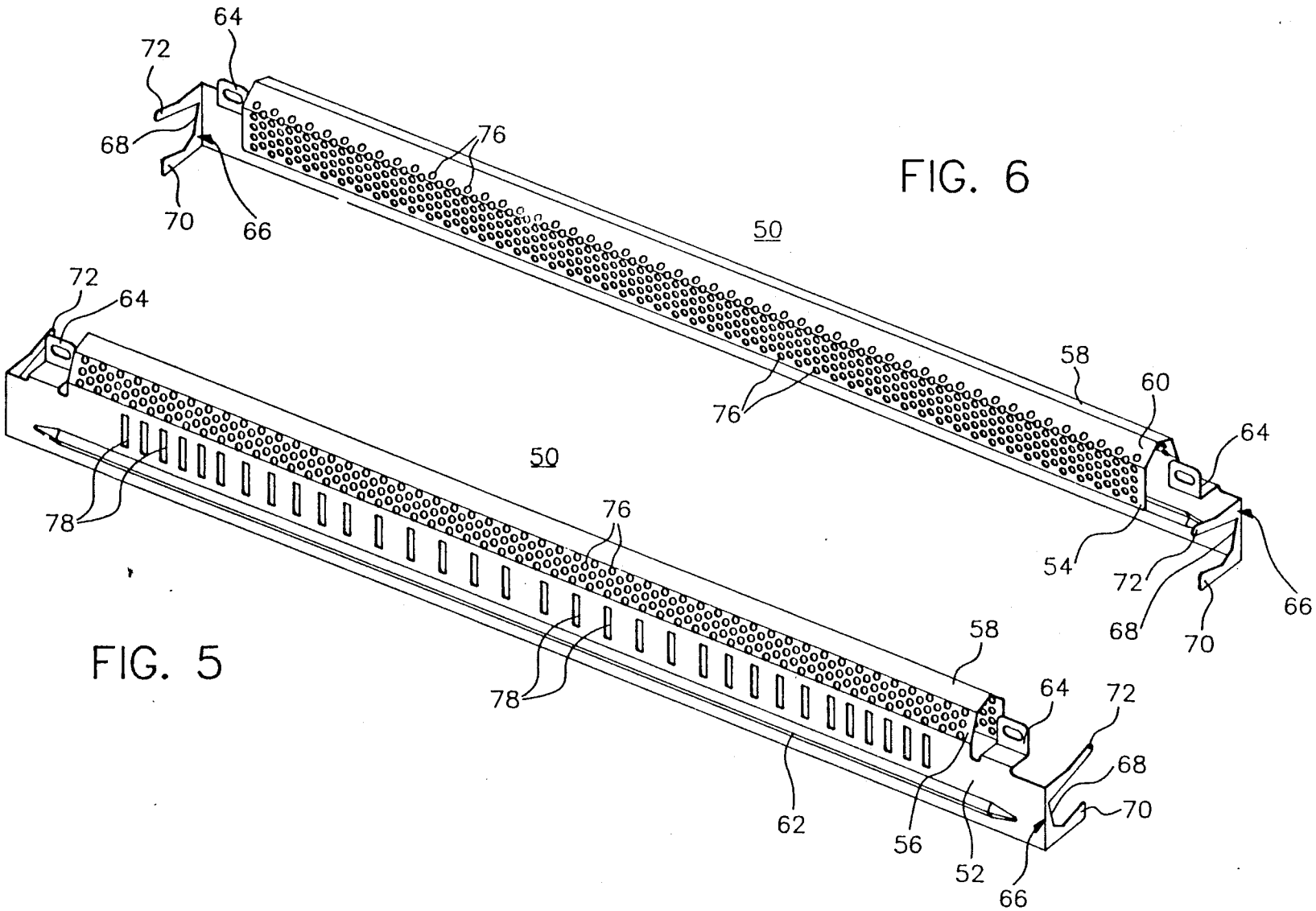
FIG. 5 is a front perspective view of the heater housing shown in FIG. 4.
FIG. 6 is a rear perspective view of the heater housing shown in FIG. 4.

Referring now to FIGS. 5 and 6, there is shown a heater housing 50 which conveniently may be constructed from sheet metal. The housing includes an elongated shield portion having a generally vertically disposed front wall 52 and generally vertically disposed rear wall 54. The front and rear walls are joined by three top walls, including a first top wall 56 which joins the front wall 52 and is angled slightly inwardly from the vertical, a second top wall 58 which angles more steeply inwardly from the first top wall 56, and a third top wall 60 which angles inwardly from the top of the rear wall 54 and joins the second top wall 58. The walls 56, 58 and 60 provide an elongated shielding portion of the housing 50 having a peaked or gabled top. An elongated reinforcing rib 62, extending along the length of the front wall 52, provides greater stiffness to the housing. At each end of the wall 52 there is formed a mounting tab 64 by which the housing 50 is mounted to the evaporator brackets 39. Also each distal end of the wall 52 is bent at 90. and is formed as a mounting bracket 66 having a slot 68 defined by a lower arm 70 and an upper arm 72, respectively.

Figure 3:
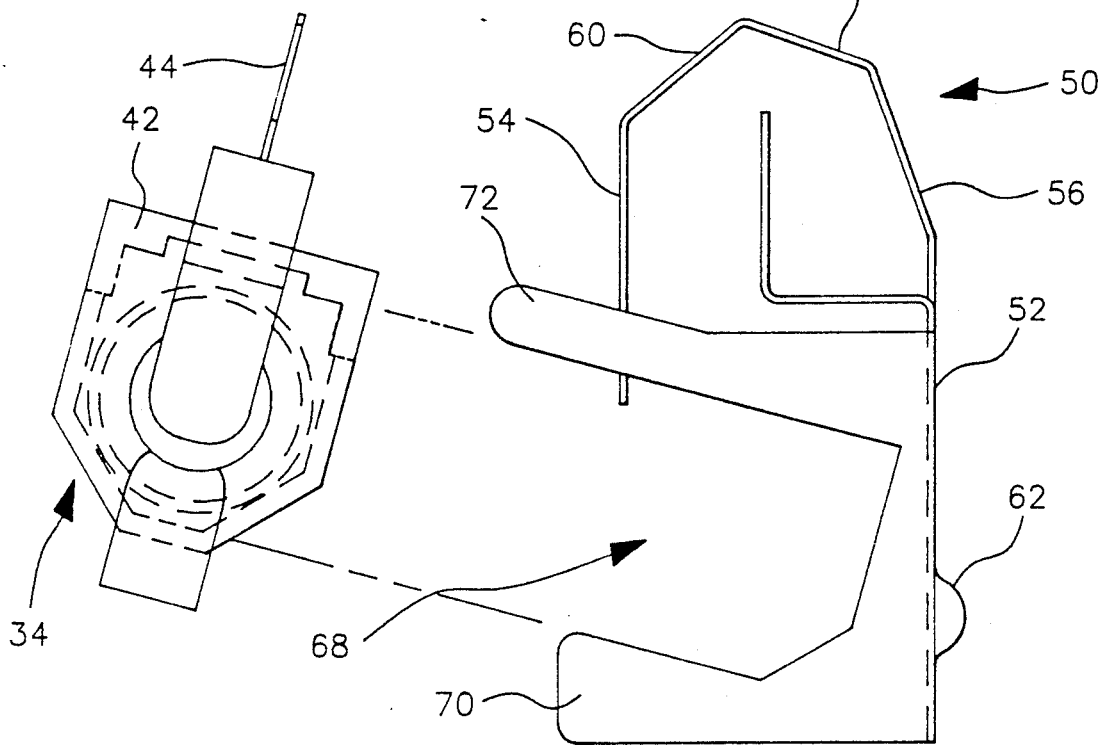
FIG. 3 is an enlarged exploded view similar to FIG. 2, but showing the heater separated from the housing.
Figure 2:
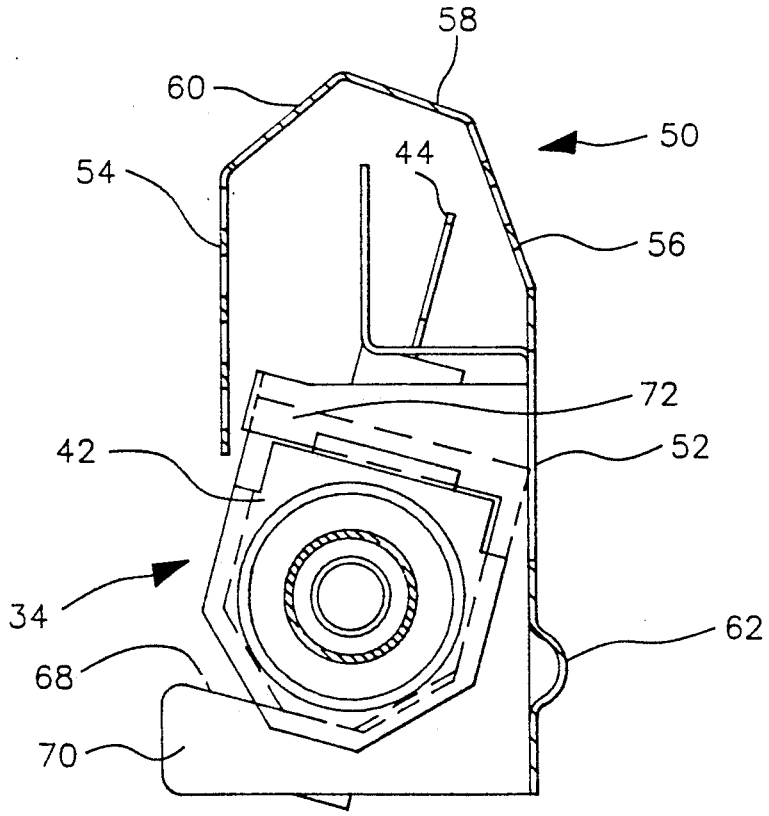
FIG. 2 is a simplified enlarged end view of the heater and heater housing of FIG 1, showing the heater mounted in the housing.

Viewing now FIGS. 2 and 3, it will be seen that the end caps 42 of the heater 34 are received in the slots 68 formed by the arms 70 and 72 and then the upper arms are bent from their extended position shown in FIG. 3 to a position closely overlying the corresponding end cap 42, as shown in FIG. 2. In this way, the heater is mounted with the elongated heater tube extending along and within the shield formed by the walls 52–60. Also, when the combined heater and housing are mounted within the evaporator compartment, the shield portion of the housing 50 is positioned between the heater and the evaporator and the walls facing the evaporator, that is principally walls 58 and 60, are inclined relative to the horizontal so that slush or water impinging on the housing from the evaporator will tend to run off. The walls 54 and 56 are perforated so as to be substantially completely covered by a plurality of spaced apart openings or holes 76. Similar holes 76 are spaced along the lower portion of wall 60. These openings or holes are sized such that the surface tension of water impinging on the shield from the evaporator during defrost operation or resulting from melting slush is great enough that the water will not pass through the holes and thus is prevented from impinging on the heater tube 40. On the other hand, there are enough holes that there is significant radiation and convection of heat from the heater tube 40 to the outside of the housing 50 so that it will effectively heat the evaporator 18 to quickly defrost it. Preferably, the openings 76 are between 0.060 inch and 0.188 inch in diameter and the openings are spaced so that there are between 16 and 32 openings per square inch of wall surface.

The vertical wall 52 is provided with a plurality of vertically extending slots 78. The spacing between the slots 78 varies along the longitudinal dimension of the wall 52, with the slots being more closely spaced toward the ends of the wall 52 and spaced farther apart toward the middle of the wall 52. While the heat density of the heater tube 40 is essentially uniform throughout its length, there still is more heat at any given point toward the middle of the tube since the middle portion of the tube is receiving heat from both axial directions while the portion toward each end is receiving heat essentially from only one longitudinal or axial direction.

The arrangement of slots counteracts this phenomenon and permits a longitudinally more uniform heat transfer through the wall 52.

Drops of water falling on the housing 50 from the evaporator tend to form into small sheets and run down the sides of the housing and drip off the bottom, thus at any one time some portion of the openings 76 and perhaps even slots 78 are covered by water. The size of the openings 76 and slots 78 are such that surface tension of the water will not permit the water to flow through them; rather it runs over the outer surface of the housing 50. However, the housing is large enough and there are enough, holes 76 and slots 78 that there always is good radiant and convection heat transfer from the heater tube 40 to the outside of the housing 50. Slush dropping onto the housing from the evaporator also will slide over the walls 52–60 and drop into the trough or bottom portion of the evaporator housing 46. If any slush or unmelted frost accumulates in the trough 46, heat from the heater 34 will melt it so that it will not stop up the drain tube 48 and essentially all of the water resulting from defrosting the evaporator will drain out of the evaporator housing through the tube 48.

While there has been shown and described what is presently considered to be a preferred embodiment of the present invention, it is to be understood that the invention is not limited thereto and it is intended in the appended claims to cover all such changes and modifications as fall within the true spirit and scope of the invention.

What is claimed is:

1. In combination:

a refrigerant evaporator normally operable at frost collecting temperatures, an elongated radiant heater adapted to operate at surface temperatures above the boiling point of water for warming said evaporator to defrost temperatures, and a housing adapted to mount said heater in substantially spaced apart heating relationship with said evaporator and below at least one frost collecting portion thereof, said housing including an elongated shield structure and spaced apart mounting means adapted to support said radiant heater with said elongated shield structure positioned between said heater and said at least one frost-collecting portion of said evaporator;

said shield structure being formed with a plurality of spaced apart openings therein, said openings being so sized that the surface tension of water impinging on said housing from said evaporator will prevent the water from passing through said shield structure and the number of said openings being sufficiently large that significant heat passes through said shield structure.

2. The combination of claim 1 wherein said spaced apart openings are between about 0.060 inch and 0.188 inch in diameter.

3. The combination of claim 1 wherein said radiant heater includes an elongated heat producing structure with a cap at each end thereof and said mounting means includes a pair of spaced apart clip structures formed integrally with said housing and adapted to support said heater caps.

4. The combination of claim 1 in which the portion of said shield structure directly above said heater is inclined.

5. The combination of claim 1 wherein said shield structure includes a generally vertically disposed portion positioned laterally adjacent said heater and having a plurality of generally vertically extending, horizontally spaced apart slots.

6. The combination set forth in claim 5 wherein adjacent ones of said slots in the middle section of said shield structure are spaced further apart than adjacent ones of said slots nearer the ends of said shield structure.

7. In a refrigerator:

wall means defining a vertically extending evaporator chamber;

a refrigerant evaporator mounted in said chamber and including a plurality of spaced apart, elongated tubular refrigerant conduit passes extending transversely of said chamber; said evaporator being normally operable at frost collecting temperatures;

an elongated radiant heater adapted to operate at surface temperatures above the boiling point of water;

a housing mounted in said evaporator chamber below said evaporator and supporting said heater below said conduit passes and extending transversely of said evaporator chamber;

said housing including an elongated sheet metal shield, at least a portion of said shield being positioned between said heater and said evaporator;

said shield having a plurality of spaced apart openings therein, said openings being sized such that the surface tension of water impinging on said shield will prevent the water from passing through said openings and the number of openings being sufficiently large that significant heat will pass therethrough.

8. The combination as set forth in claim 7 wherein said openings are between about 0.060 inch and 0.188 inch in diameter.

9. The combination as set forth in claim 7 wherein said radiant heater includes an elongated tubular heat producing structure with a cap at each of its ends and said housing includes a pair of integral mounting clips spaced apart to receive corresponding ones of said caps.

10. The combination as set forth in claim 7 wherein said portion of said shield between said heater and said evaporator is inclined.

11. The combination as set forth in claim 7 wherein said shield includes a generally vertically disposed portion positioned laterally adjacent said heater and having a plurality of vertically extending, horizontally spaced apart slots therein.

12. The combination as set forth in claim 11 wherein the spacing between adjacent ones of said slots located more toward the center of said shield is greater than the spacing between adjacent ones of said slots located more toward the ends of said shield.

* * * * *